United States Patent [19]

Meier

[11] Patent Number: 4,550,822

[45] Date of Patent: Nov. 5, 1985

[54] APPARATUS FOR TRANSPORTING FLAT PRODUCTS, ESPECIALLY PRINTED PRODUCTS ARRIVING IN AN IMBRICATED FORMATION

[75] Inventor: Jacques Meier, Bäretswil, Switzerland

[73] Assignee: Ferag AG, Hinwil, Switzerland

[21] Appl. No.: 470,590

[22] Filed: Feb. 28, 1983

[30] Foreign Application Priority Data

Mar. 11, 1982 [CH] Switzerland ..... 1491/82

[51] Int. Cl.[4] ..... B65G 47/31

[52] U.S. Cl. ..... 198/461; 198/579; 198/623; 271/202

[58] Field of Search ..... 198/461, 620, 623, 579, 198/650, 654; 271/202, 203, 204, 270, 277, 69, 119

[56] References Cited

U.S. PATENT DOCUMENTS

| | | | |
|---|---|---|---|
| 4,201,286 | 5/1980 | Meier | 198/461 |
| 4,424,965 | 1/1984 | Faltin | 271/204 X |

FOREIGN PATENT DOCUMENTS

| | | | |
|---|---|---|---|
| 75121 | 8/1982 | European Pat. Off. | 271/270 |
| 2207175 | 9/1973 | Fed. Rep. of Germany | 271/202 |
| 2741187 | 5/1978 | Fed. Rep. of Germany | 271/119 |
| 2917250 | 10/1980 | Fed. Rep. of Germany | 271/202 |
| 261045 | 5/1927 | United Kingdom | 271/79 |
| 589389 | 6/1947 | United Kingdom . | |
| 1087853 | 10/1967 | United Kingdom | 271/69 |
| 1455856 | 11/1976 | United Kingdom | 198/650 |
| 2024176 | 1/1980 | United Kingdom . | |

*Primary Examiner*—Joseph E. Valenza
*Assistant Examiner*—Jonathan D. Holmes
*Attorney, Agent, or Firm*—Werner W. Kleeman

[57] ABSTRACT

Printed products arriving in an imbricated product formation are fed to spaced gripper units of a transport device by a belt conveyor. The conveying direction of the belt conveyor forms an acute angle with the transport direction of the transport device. The transporting rate or velocity of the belt conveyor is greater than the transporting rate or velocity by the transport device. Each gripper unit comprises a stationary clamping jaw, a pivotable clamping jaw, and a plate-shaped stop. The pivotable clamping jaw is pivoted against the action of a closing spring by a cam structure or the like. The printed products are first accelerated and then pushed into the open gripper mouth until abutting the stop in order to thereby align the printed products at the region of their leading edges. At the region of their trailing edges, the printed products remain under the conveying action of the belt conveyor at least until the gripper units are closed.

13 Claims, 2 Drawing Figures

APPARATUS FOR TRANSPORTING FLAT PRODUCTS, ESPECIALLY PRINTED PRODUCTS ARRIVING IN AN IMBRICATED FORMATION

BACKGROUND OF THE INVENTION

The present invention broadly relates to an apparatus for transporting flat products, especially printed products, arriving in an imbricated product formation.

In its more specific aspects the present invention relates to a new and improved construction of apparatus for transporting continuously arriving flat products, which apparatus is of the type comprising feeding or infeed means for feeding the printed products to a transport means or device having the same transport direction as the infeed means. Gripper units are arranged in spaced relationship at the transport means and serve to take over the printed products supplied thereto and to hold the same at the leading edges thereof for further transport. At the transfer region the conveying path of the products supplied by the feeding or infeed means forms an acute angle with the travel path of the gripper units of the transport means.

In a transport apparatus of such type suitable measures must be undertaken to ensure that the gripper units or grippers of the transport means can correctly grip the products delivered by the feeding or infeed means in the direction of movement of the gripper units. In transport means as known, for example, from U.S. Pat. No. 3,955,667, this is achieved by gripper units which are provided with a rearwardly directed, stationary upper clamping tongue or jaw and a movable lower clamping tongue or jaw which is laterally directed in the opened position of the gripper units. For seizing the printed products the lower clamping tongue or jaw is firstly pivoted into a position where it is aligned with the upper clamping tongue or jaw and subsequently is moved towards the upper clamping tongue or jaw. The infeed of the printed products has to be accommodated to the movement of the gripper units such that at the transfer region a respective gripper unit meets the printed product in a correct position. During the course of the pivoting movement the lower clamping tongue or jaw is moved beneath the printed product below the leading edge thereof, so that the seized printed product is firmly clamped when the two mutually aligned clamping tongs or jaws are brought together or closed.

In this state-of-the-art transport apparatus the printed products are taken-over by the transport means in the same mutual position they assume in the product formation supplied by the feeding or infeed means. Thus, the product take-over or transfer occurs neither with mutual alignment of the printed products nor with any compensation for different distances between the products.

It may occur that the distance of one product to the leading product deviates rather markedly from the standard or rated distance. While in such a case the gripper units are still able to grip such product, the latter is held, however, only just between the outermost ends of the clamping tongs or jaws. There is, then, the danger that such product can be unintentionally released from the gripper unit during the subsequent transport of the product due to the insufficient clamping action which thus prevails.

SUMMARY OF THE INVENTION

Therefore, with the foregoing in mind it is a primary object of the present invention to provide a new and improved construction of apparatus for transporting flat products, especially printed products, arriving in an imbricated formation which enables the products to be safely and positively gripped even at high feeding rates or velocities.

Another important object of the present invention is directed to the provision of a new and improved construction of apparatus for transporting flat products, especially printed products, arriving in an imbricated formation which enables the products to be safely and positively gripped even if the products are non-uniformly arranged with respect to each other in the arriving product formation.

Still a further significant object of the present invention is directed to a new and improved construction of an apparatus for transporting flat products, especially printed products, which arrive in an imbricated formation in which the products are aligned during the course of the transfer to the transport means.

Another significant object of the present invention is directed to a new and improved construction of an apparatus for transporting flat products, especially printed products, arriving in an imbricated formation, in which different distances between the products in the product formation can be effectively compensated.

Now in order to implement these and still further objects of the invention, which will become more readily apparent as the description proceeds, the apparatus of the present development is manifested by the feature that, the transporting or feeding rate of the feeding or infeed means is greater than the transporting rate or velocity of the transport means.

The products which are supplied to the transport means at a higher velocity than the transporting rate or velocity of the transport means catch up with the gripper units or grippers of the transport means and are pushed into the opened gripper units. It is thus ensured that even in case of somewhat too large spaces or distances between two consecutive products the latter can enter an opened gripper unit to a sufficient extent in order to be safely and positively gripped thereby.

When each gripper unit is provided with a stop for the product running into the opened gripper unit, then the products fed towards and abutting against their related stop will be aligned at the region of their leading edges by abutting the stop prior to closure of the relevant gripper unit. Since the stops of all gripper units substantially have the same position with respect to the transporting direction of the transport means the products will be mutually aligned as they are taken-over by the transport means, and specifically independently of the mutual position of the products within the inbound product formation.

To enable the products to run correctly into the opened gripper units as well as to ensure for a safe and positive abutment thereof at the stops of the gripper units, the feeding or infeed means are designed to feedingly act upon the products, at least until the same abut the stops and, preferably, until closure of the gripper units.

In the event that the products, especially printed products, arrive in an imbricated product formation, then the products will have different mutual positions and distances from each other. In such case the position of the products in the formation can be made more uniform prior to take-over of the products by the transport means, if conveying means are arranged upstream of the feeding means and which are driven at a conveying rate or velocity which is smaller than the feeding rate or velocity of the feeding means, and accelerating means are arranged to act upon the products conveyed by the conveying means in order to accelerate the same. The accelerating means or device may be designed to periodically act upon the products and to engage one of the products during each period of interaction. The accelerating means may comprise at least one accelerating element which is arranged on one side of the product travel path and which is rotationally driven so as to engage respective ones of the products at defined time intervals. A conveyor roller may be arranged following the accelerating means, and, a conveying gap is defined by the conveyor roller and the feeding means. With such design of the transport apparatus it now is possible in such case to render more uniform the position the products assume in the product formation prior to take-over of the same by the transport means. By virtue of such preparatory processing of the products the subsequent seizure and alignment thereof by the gripper units is facilitated.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
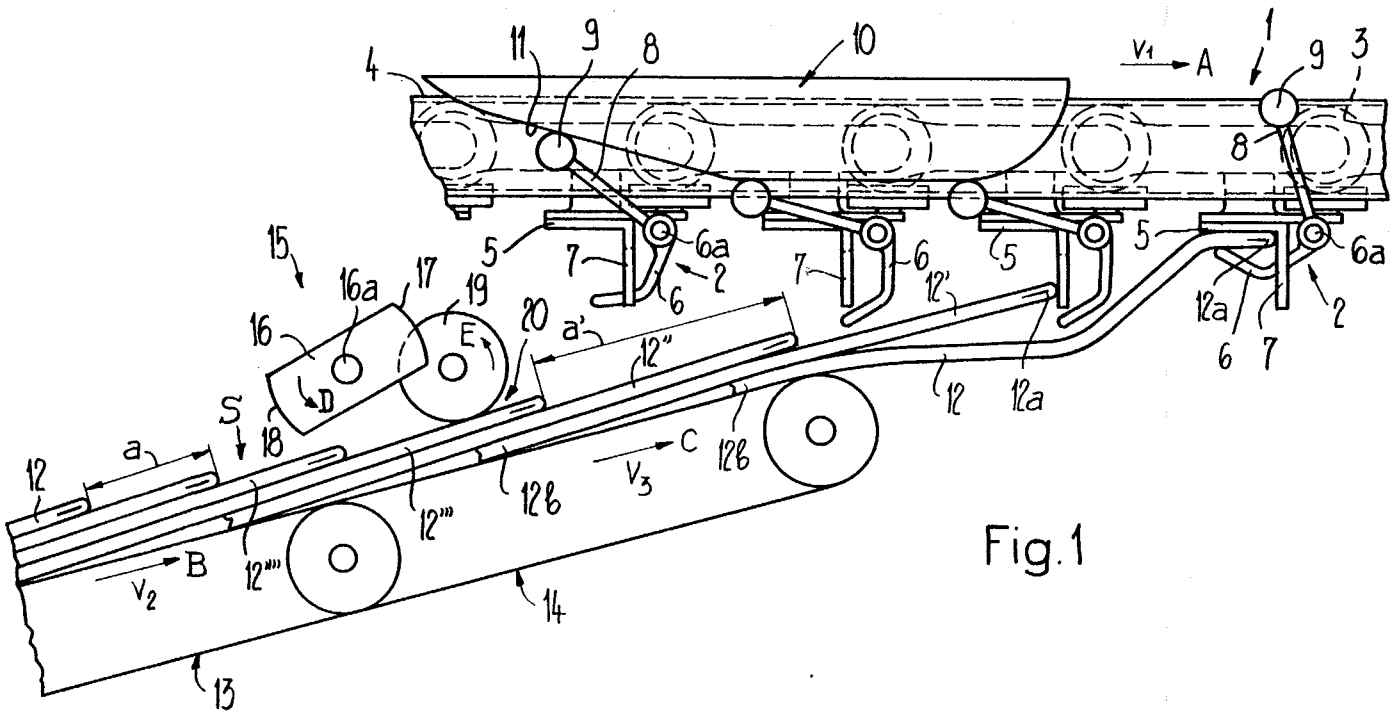
FIGS. 1 and 2 show purely schematically and in side view the take-over or transfer region in a transport apparatus constructed according to the invention for transporting printed products and depicted at different moments during the course of its operation.

Describing now the drawings, it is to be understood that only enough of the construction of the transport apparatus has been shown as needed for those skilled in the art to readily understand the underlying principles and concepts of the present development, while simplifying the showing of the drawings. Turning attention now specifically to FIGS. 1 and 2, there has been schematically illustrated therein a transport means or device, generally designated by reference numeral 1, of which only a section has been conveniently shown. As seen in the transport or feed direction A the transport means 1 comprise individually controllable gripper units or grippers 2 which are shown purely schematically and which are arranged in succession at regular intervals. The gripper units 2 are mounted at a traction element 3 which is guided in a guide channel or passage 4. The traction element 3 shown in FIG. 1 in broken lines is preferably a ball-and-socket link chain structure containing ball-and-socket joints; such type of traction elements are described in greater detail in U.S. Pat. No. 4,294,345 and U.S. Pat. No. 4,320,894, to which reference may be had and the disclosure of which is incorporated herein by reference. Each of the gripper units 2 comprises a stationary clamping jaw 5 as well as a movable clamping jaw 6 which is pivotable about an axis or pivot shaft **6*a* which extends essentially at right angles to the transport direction A. To the front end of the stationary clamping jaw 5, as seen in the transport direction A, there is connected a plate-shaped stop or abutment member 7 extending substantially at right angles with respect to the transport direction A and normally with respect to the associated stationary clamping jaw 5. The stop 7** serves as a front limit or boundary of the gripper or clamping jaw which is open towards the rear with respect to the transport direction A.

The two clamping jaws 5 and 6 are maintained in their closed position by the action of any suitable closing spring in the manner described for the gripper units disclosed in the aforementioned U.S. Pat. No. 4,320,894. For pivoting the movable clamping jaws 6 are each connected to a related lever 8 carrying a roller or roll 9 at its free end. A stationary guiding block or cam 10 or equivalent structure comprising a control track or cam surface 11 formed at the underside thereof is arranged at the product take-over or transfer region as shown in the Figures. When the gripper units 2 pass the guiding block or cam 10, the rollers 9 travel onto the control track or cam surface 11 which, due to the design thereof, results in the movable clamping jaws 6 being pivoted against the action of their related closing spring into their opened position and the movable clamping jaws 6 being maintained in this opened position. As shown in the Figures, the gripper units 2 remain in the opened state until the rollers 9 leave or run-off the guiding block or cam 10 and the movable clamping jaws 6 are pivotably returned back into their closed position by the action of the closing spring.

The printed products 12 which are to be outfed by the transport means 1 are supplied by a first belt conveyor 13, the feeding direction of which is designated by reference character B. The printed products 12 continuously arrive in an imbricated formation S in which each printed product rests upon the respective preceding or leading printed product. The leading edges **12*a* (folding edges) of the printed products 12 are thus lying free while the trailing edges 12*b* thereof are covered by the respective following or trailing printed product 12. With their rear portion the printed products 12 rest upon the belt conveyor 13**.

A second belt conveyor 14 which also is only shown purely schematically, follows the first belt conveyor 13 and serves as a feeding or infeed means for supplying the printed products 12 to the transport means 1. The second belt conveyor 14 has a feeding or transport direction C which registers with the conveying direction B of the first belt conveyor 13. The feeding rate or velocity $V_3$ of the second belt conveyor 14 is, for reasons still to be described, twice the conveying rate or velocity $V_2$ of the first belt conveyor 13. Furthermore, the feeding rate $V_3$ of the second belt conveyor 14 is greater than the transporting rate or velocity $V_1$ of the transport means 1. The transport direction A of the transport means 1 and the feeding or transport direction C of the second belt conveyor 14 are in the same direction, however, form an acute angle which in the present case, is in a range between 10° and 15°. The feeding or conveying path of the printed products 12 governed by the second belt conveyor 14 thus extends at an acute angle with respect to the travel or transport path of the gripper units 2 at the product transfer region.

Accelerating means 15 are arranged above the travel path of the printed products 12 at the transition region between the first belt conveyor 13 and the second belt conveyor 14. The accelerating means 15 comprise an accelerating element 16 which has only been schematically illustrated and which is driven for rotation about an axis 16a in the direction of the arrow D. The accelerating element 16 has two curved engagement surfaces or faces 17 and 18 which are arranged opposite one another with respect to the rotational axis 16a. By means of the engagement surfaces or faces 17 and 18 the accelerating element 16 acts upon the top side of the arriving printed products 12 in a manner still to be described. The accelerating element 16 is driven at such a number of revolutions per unit of time that the circumferential speed thereof substantially corresponds to the feeding rate or velocity $V_3$ of the second belt conveyor 14. Thus, the circumferential speed of the accelerating element 16 is about twice the conveying rate $V_2$ of the first belt conveyor 13.

As seen in the feeding or transport direction C of the second belt conveyor 14, a conveyor roller or roll 19 is arranged following the accelerating element 16. This downstream arranged conveyor roller 19 is driven for rotation in the direction of the arrow E such that the circumferential speed thereof also corresponds to the feeding rate or velocity $V_3$ of the second belt conveyor 14. The conveyor roller 19 is arranged at a distance above the second belt conveyor 14, and a conveying gap 20 for the printed products 12 is formed by the interaction of the conveyor roller 19 and the second belt conveyor 14.

Figure 2:
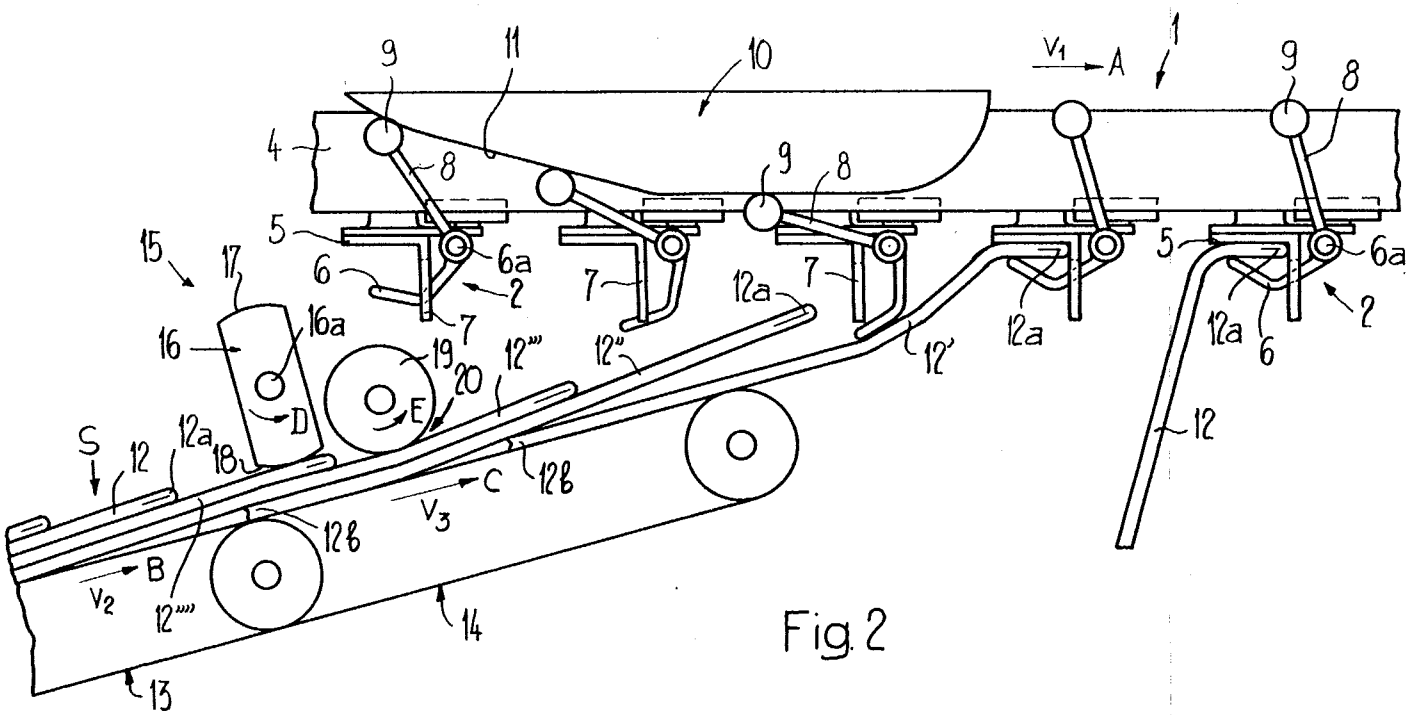

The mode of operation of the transport apparatus illustrated in FIGS. 1 and 2 at two different moments of time will now be explained hereinafter.

The printed products 12 resting upon the second belt conveyor 14 are fed to the transport means 1 at an acute angle at a feeding rate or velocity $V_3$ which, as already mentioned hereinbefore, is greater than the transporting rate or velocity $V_1$ of the transport means 1. Due to their greater velocity the printed products 12 catch-up with the open gripper units 2 and run into the opened gripper or clamping jaw until they abut the stop 7, as such has been illustrated in FIG. 1 for a printed product designated by reference numeral 12'. As will also be evident from FIG. 1, the second belt conveyor 14 is arranged with respect to the transport means 1 such that the printed products 12 still continue to rest upon the second belt conveyor 14 at the moment of abutting the stop 7. Therefore, the printed products 12, at the region of their trailing edge 12b, are still subjected to the feeding action of the second belt conveyor 14, on the one hand, and to that of the following printed product 12'' resting thereupon which is still exposed to the feeding or transport action of the conveyor roller or roll 19 (see FIG. 1), on the other hand, at the moment of abutment against the stop 7 and also beyond such time. By virtue of the feeding action exerted upon the printed product 12' it is ensured that this printed product 12' will be pushed against the stop 7 at the leading edge 12a thereof. The printed product 12' is thus aligned at its leading edge 12a.

After abutment and alignment of the printed product 12' the gripper unit 2 commences to close. As clearly shown in FIG. 1, the gripper unit 2 is completely closed before the printed product 12 is released at its trailing edge 12b from the second belt conveyor 14. It is thus ensured that the printed product 12 will be firmly clamped at the leading edge 12a thereof in its aligned position. Since, as mentioned hereinbefore, the feeding rate or velocity $V_3$ of the second belt conveyor 14 is greater than the transporting rate or velocity $V_1$ of the transport means 1, the printed product which, after closure of the gripper unit 2, still rests upon the second belt conveyor 14 with its trailing edge 12b, will bulge or buckle as illustrated in FIG. 1 with reference to the printed product designated by reference numeral 12. After release from the second belt conveyor 14 the rear portion of the printed product 12 can adapt to the position of the front portion thereof which is firmly held and aligned by the gripper unit 2. Thus, the printed products 12 led away by the transport means 1 are collectively aligned with respect to the stops 7 in the manner as such has been shown in FIG. 2 for the printed product designated by reference numeral 12. Since the stops or abutment members 7 of the gripper units 2 are also aligned with respect to each other, the printed products 12, in the product formation outfed by the transport means 1, assume a uniform mutual position.

The mode of operation of the accelerating means 15 will now be explained hereinafter.

During its rotation the accelerating element 16 acts twice upon the printed products 12 supplied by the first belt conveyor 13, each time by means of one of the two engagement surfaces or faces 17 and 18 thereof. FIG. 2 shows the moment at which the accelerating element 16 engages the printed product 12'''' with its engagement surface or face 18. The printed product 12'''' which is moved at the rate determined by the conveying rate or velocity $V_2$ of the first belt conveyor 13 is accelerated by the accelerating element 16 to the feeding rate or velocity $V_3$ of the second belt conveyor 14. Prior to disengagement of the accelerating element 16 from the printed product 12'''' the latter runs into the conveying gap 20 and is engaged by the conveyor roller 19. The conveyor roller 19 now together with the second belt conveyor 14 causes the printed products 12 to be moved further at the feeding rate or velocity $V_3$.

By means of the accelerating element 16 the printed products 12 will be accelerated to the feeding rate or velocity $V_3$ which is twice the conveying rate or velocity $V_2$ of the first belt conveyor 13. Therefore, the spacing or distance a between consecutive printed products, i.e. the distance between the printed products forming the imbricated formation as shown in FIG. 1, is increased, namely doubled. This increased distance of the printed products in the imbricated formation is designated by reference character a' in FIG. 1. If the distance a between the printed products 12 in the imbricated product formation is non-uniform, i.e. if the distance between the printed products in the imbricated product formation deviates from a desired value a, and the printed products 12 are conveyed to the accelerating means 15, then the absolute amount of the deviation will not be changed by the acceleration of the printed products 12 as mentioned before, however, after acceleration the relative deviation from the desired value of the distance will be smaller due to the increase in the distance or spacing between the printed products in the imbricated formation to the value a'. Since the accelerating element 16 acts periodically for a certain amount of time upon the arriving or inbound printed products 12, the position of those printed products 12 is evened out which assume an oblique position in the imbricated product formation S which is conveyed by the first belt conveyor 13. Thus, the mutual position of the printed products 12 as well as their mutual distance or spacing from one another are balanced or compensated by the accelerating means 15. Consequently, there is ensured a faultless take-over or transfer of the printed products 12 by the transport means 1 even when the printed products 12 are non-uniformly arranged in the imbricated product formation S conveyed by the first belt conveyor 13.

It will be evident from the foregoing that instead of the accelerating element 16 which acts only periodically upon the printed products 12 supplied thereto, one or more accelerating rollers can be provided in case that the printed products 12 delivered by the first belt conveyor 13 have uniform distances a in the imbricated product formation and are aligned with respect to each other.

While only one accelerating element 16 and only one conveyor roller or roll 19 have been shown, it is conceivable and even necessary in some cases to juxtapositionally arrange two or more accelerating elements 16 and conveyor rollers 19, respectively.

It will be understood that some of the parts or members in the transport apparatus described hereinbefore may also be designed differently. Thus, for example, other suitable accelerating means may be utilized instead of the accelerating element 16. The two belt conveyors 13 and 14 may be of any other suitable type. Instead of the belt conveyors 13 and 14 also other suitable conveying or feeding means can be provided. Also, it is possible to design the transport means 1 and particularly the gripper units 2 thereof in a manner which is different from the exemplary illustrated and disclosed design.

The printed products 12 taken-over by the transport means 1 are transferred by such transport means 1 to a suitable processing location which is more or less distant from the take-over or transfer region. Thus, it is also conceivable that, for example, the aligned printed products 12 are again released just shortly after having been taken-over by the transport means 1. In such case the transport means 1 primarily would serve to align the printed products as described hereinbefore.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for transporting flat products, especially printed products, arriving in an imbricated product formation, comprising:

feeding means for infeeding the products at a predetermined feeding velocity in a predetermined product feeding direction and defining a product feeding path;

conveying means arranged upstream of said feeding means with respect to said predetermined product feeding direction and operated at a conveying velocity which is smaller than said predetermined feeding velocity of said feeding means, said feeding means and conveying means being substantially coplanar;

continuously driven accelerating means arranged to act periodically upon said products supported by said conveying means in order to accelerate said products;

transport means for transporting the products at a predetermined transporting velocity in a product transport direction;

said transport direction extending in the same general direction as said feeding direction;

said feeding means supplying said products to said transport means;

individually controllable gripper units arranged at said transport means in spaced relationship from each other and movable along a predetermined travel path;

each gripper unit serving to take-over the products supplied thereto and to engage at least one of said products supplied thereto at a leading edge thereof for further transport of such engaged product;

a product transfer region defined by said feeding means and by said transport means;

said feeding path of said products supplied by said feeding means forming an acute angle with said travel path of said gripper units; and said feeding velocity of said feeding means being greater than said transporting velocity of said transport means.

2. The apparatus as defined in claim 1, further including:

a stop provided for each said gripper unit and against which impacts said at least one product running into said gripper unit in the open position thereof.

3. The apparatus as defined in claim 2, wherein:

said stop extends transversely with respect to said transport direction of said transport means.

4. The apparatus as defined in claim 3, wherein:

said stop extends substantially at right angles with respect to said transport direction of said transport means.

5. The apparatus as defined in claim 2, further including:

closing means for closing each gripper unit after said at least one product has impacted against said stop.

6. The apparatus as defined in claim 5, wherein:

said feeding means being structured to feedingly act upon said products at least until a respective one of said gripper units is closed by said closing means.

7. The apparatus as defined in claim 2, wherein:

said feeding means being structured to feedingly act upon said products at least until a respective one thereof impacts against said stop.

8. The apparatus as defined in claim 7, wherein:

said feeding means comprises a belt conveyor; and each said product resting upon said belt conveyor at least until impacting against a respective one of said stops.

9. The apparatus as defined in claim 1, wherein:

said accelerating means are structured to periodically act upon said products; and said accelerating means engage one of said products during each period of interaction therewith.

10. The apparatus as defined in claim 10, wherein:

said accelerating means contain at least one accelerating element;

said at least one accelerating element being arranged at one side of a travel path of said products and being rotationally driven; and said accelerating element engaging respective ones of said products at predetermined time intervals.

11. The apparatus as defined in claim 10, wherein:

said accelerating element is arranged above said travel path.

12. The apparatus as defined in claim 1, further including:

a conveyor roller arranged after said accelerating element; and a conveying gap formed between said conveyor roller and said feeding means.

13. The apparatus as defined in claim 12, wherein:

said feeding means comprise a belt conveyor.

* * * * *